US006138276A

United States Patent [19]

Asciutto et al.

[11] Patent Number: 6,138,276

[45] Date of Patent: Oct. 31, 2000

[54] UNDERARM PERSPIRATION SHIELDS

[76] Inventors: Cathy L. Asciutto; Linda J. Pinney, both of 425 8th St., Del Mar, Calif. 92014

[21] Appl. No.: 09/241,117

[22] Filed: Feb. 1, 1999

[51] Int. Cl.[7] ..... A41D 27/13

[52] U.S. Cl. ..... 2/53; 2/54; 2/55; 450/57

[58] Field of Search ..... 450/1, 23, 26, 450/28, 30, 31, 33, 3–11, 57, 58, 89; 2/1, 104, 53–56, 58

[56] References Cited

U.S. PATENT DOCUMENTS

| | | | |
|---|---|---|---|
| 815,186 | 3/1906 | Lockie | 2/53 |
| 855,638 | 6/1907 | Jackson | 2/58 |
| 1,122,113 | 12/1914 | Hausner | 2/58 |
| 1,137,452 | 4/1915 | Bienstock | 2/58 |
| 1,257,617 | 2/1918 | Lee | 2/53 |
| 1,348,754 | 8/1920 | Shrader | 2/53 |
| 1,550,799 | 8/1925 | George | 2/58 |
| 2,028,599 | 1/1936 | Goodman | 2/58 |
| 2,115,333 | 4/1938 | Isaac | 2/58 |
| 2,886,820 | 5/1959 | Morris | 2/58 |
| 5,042,089 | 8/1991 | Carmer . | |
| 5,245,707 | 9/1993 | Green . | |

*Primary Examiner*—Gloria M. Hale

*Attorney, Agent, or Firm*—John R. Ross; John R. Ross, III

[57] ABSTRACT

An underarm perspiration shield that attaches to the shoulder strap of a wearer's undergarment. The elements of the present invention include an absorption pad suitable for absorbing perspiration from a wearer's armpit and two straps that are connected to opposite ends of the absorption pad. The ends of the two straps loop around the shoulder strap of the wearer's undergarment, and attach to the absorption pad through an attachment means. In a preferred embodiment the absorption pad is laminated with the side closest to the wearer's armpit being cotton and the side closest to the outer garment being PVC. Also, in the preferred embodiment, each of the ends of the two straps are attached to the absorption pad with a Velcro® hook and loop structure.

16 Claims, 5 Drawing Sheets

UNDERARM PERSPIRATION SHIELDS

The present invention relates to clothing accessories, and more particularly to clothing accessories that help prevent underarm perspiration from contacting clothing.

BACKGROUND OF THE INVENTION

As a woman perspires, the stain from her sweat can cause garment damage. Also, antiperspirant and deodorant stains can damage garments as well. In order to remain presentable, the garment needs to be cleaned after being stained with perspiration or an antiperspirant/deodorant. Cotton shirts and other durable fabrics can be laundered. However, delicate fabrics such as silk dresses and blouses require dry cleaning. Regardless of the manner of cleaning, each time a garment is cleaned, its overall quality deteriorates. Therefore, in order to preserve the quality of ones clothing, the number of times a garment is cleaned should be minimized.

A large percentage of perspiration occurs at the armpit. Devices designed to absorb underarm perspiration are known. U.S. Pat. No. 5,245,707 discloses a dress shield device that is designed to "absorb perspiration and protect garments from deodorant discoloration." The disadvantage of U.S. Pat. No. 5,245,707 resides primarily in the fact that it is a bulky and cumbersome undergarment that is difficult to manufacture and use. U.S. Pat. No. 5,042,089 discloses another dress shield device for protecting garments from underarm perspiration. However, U.S. Pat. No. 5,042,089 also does not present an adequate solution because its difficult to attach (i.e., requires sewing) to the wearer's bra. It is also bulky and covers areas of the arm that do not need protection (i.e., the top of the shoulder). Also, when the U.S. Pat. No. 5,042,089 device is cleaned, the entire bra must be cleaned as well since they are permanently attached.

What is needed better underarm perspiration shield.

SUMMARY OF THE INVENTION

The present invention provides an underarm perspiration shield that attaches to the shoulder strap of a wearer's undergarment. The elements of the present invention include an absorption pad suitable for absorbing perspiration from a wearer's armpit and two straps that are connected to opposite ends of the absorption pad. The ends of the two straps loop around the shoulder strap of the wearer's undergarment, and attach to the absorption pad through an attachment means.

In a preferred embodiment the absorption pad is laminated with the side closest to the wearer's armpit being cotton and the side closest to the outer garment being PVC. Also, in the preferred embodiment, each of the ends of the two straps are attached to the absorption pad with a Velcro® hook and loop structure.

DETAILED DESCRIPTION OF PREFERRED EMBODIMENTS

The present invention provides an underarm perspiration shield that enables a wearer to prevent underarm sweat from contacting her clothing. The shield is inexpensive, inconspicuous and easy to attach to most bras, slips or tank top T-shirts.

First Preferred Embodiment

Figure 1:
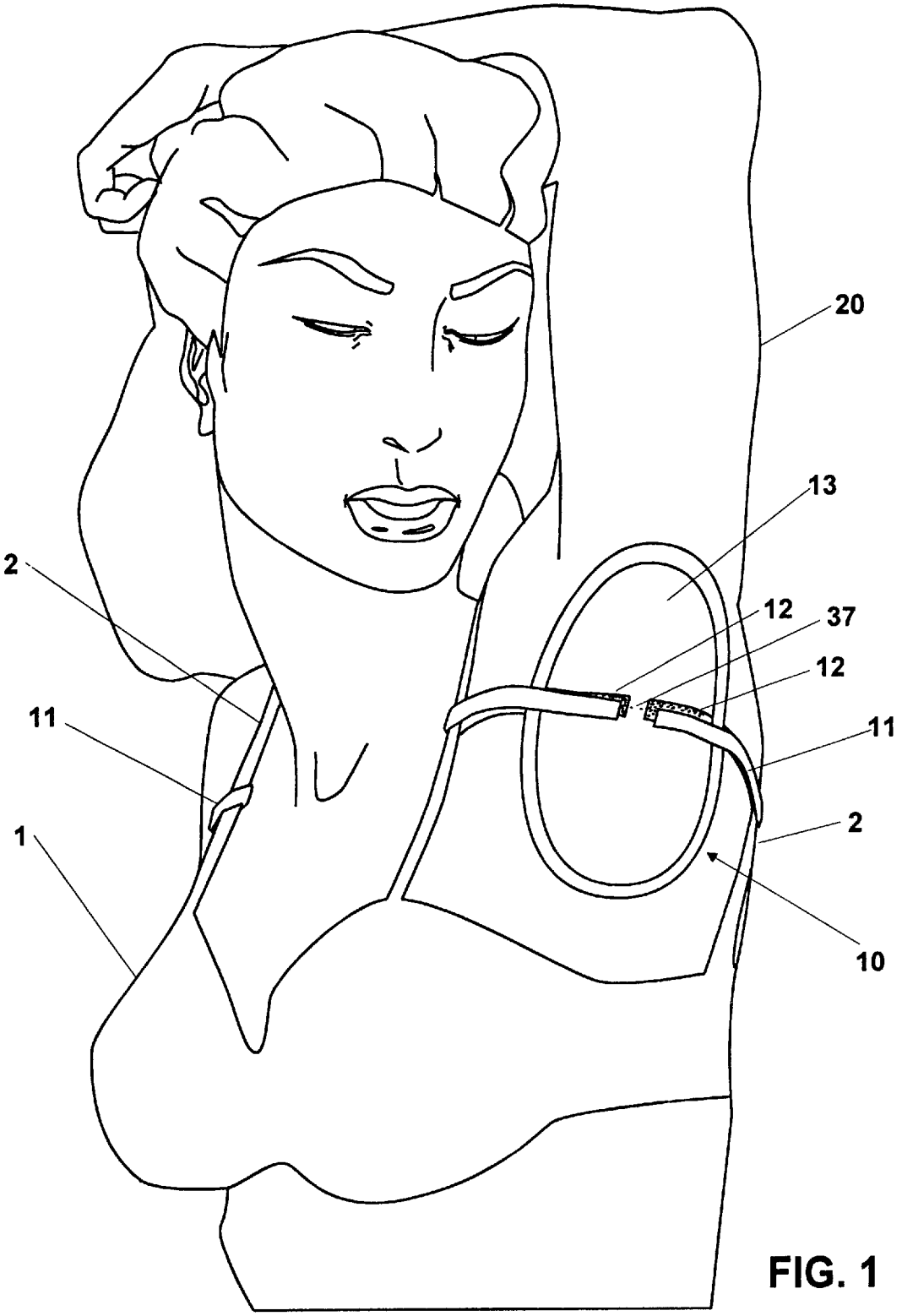
FIG. 1 is a drawing showing a preferred embodiment of the present invention attached to a bra.

FIG. 1 shows a preferred embodiment in use. The wearer, shown wearing bra 1, has her arm 20 raised. Underarm perspiration shield 10 is shown attached to bra 1. Absorption pad 13 is held against the armpit by looping shield straps 11 around bra straps 2. The ends of shield straps 11 are connected to shield 10 through a Velcro® connection. Velcro® refers generally to the hook and loop structure that when pressed together provides that two parts carrying the Velcro® are releasably joined. Velcro® hook sections 12 are sewn to absorption pad 13. Velcro® loop sections (not shown in FIG. 1) are sewn to the inside of shield straps 11 and are pressed against Velcro® hook sections 12, thereby connecting the ends of shield straps 11 back to absorption pad 13. Preferably, absorption pad 13 has a 4 mil thick PVC (polyvinyl chloride) side and a number 1 cotton baby rib cotton side. The cotton side is situated next to the skin and absorbs perspiration released from the armpit. The PVC side prevents the perspiration from seeping through shield 10 to the wearer's clothing. As shown in FIG. 1, seam 37 is situated so that its position is adjacent to the armpit of the wearer. A pivot crease is formed along seam 37 which allows for the easy raising and lowering of the arm without significantly upsetting the position of shield 10.

Assembly of the First Preferred Embodiment

A. Fabricating the Absorption Pad

Cutting Out the Die Cut Piece

Figure 2A:
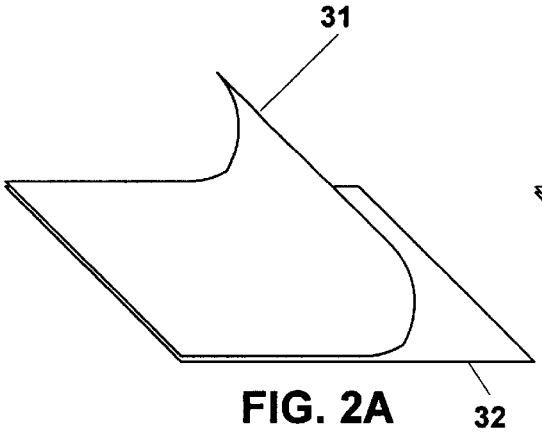
FIGS. 2A and 2B show a PVC sheet being laid on top of a cotton sheet.
Figure 2B:
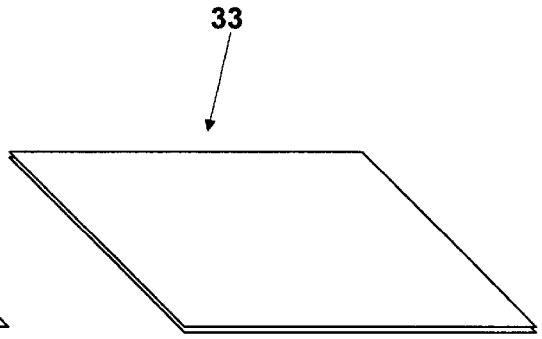
Figure 3:
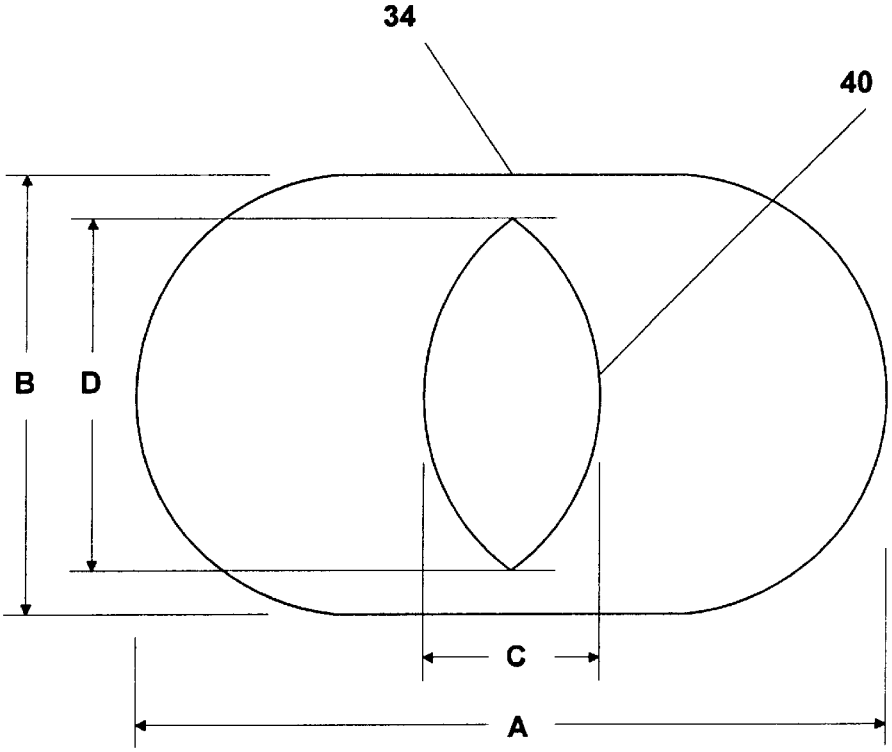
FIG. 3 shows a die cut piece.

A 1 yard×1 yard PVC sheet 32 is covered with a fabric adhesive. A preferred fabric adhesive is FABRI-TAC™. FABRI-TAC™ is a fabric adhesive manufactured by the Beacon Chemical Co. with offices in Mt. Vernon, N.Y. and is available from WE-R-FABRIC, with offices in Solana Beach, Calif. Then, as shown in FIGS. 2A and 2B, a 1 yard×1 yard cotton sheet 31 is laid on top of adhesive covered PVC sheet 32 forming laminated sheet 33. From laminated sheet 33, forty die cut pieces 34 are cut. The shape of die cut piece 34 is shown in FIG. 3. Die cut piece 34 has center-opening 40 cut out from its center. Preferably, dimension A is approximately 7⅝ inches, dimension B is approximately 4⅝ inches, dimension C is approximately 1 13/16 inches, and dimension D is approximately 4 inches.

Figure 4:
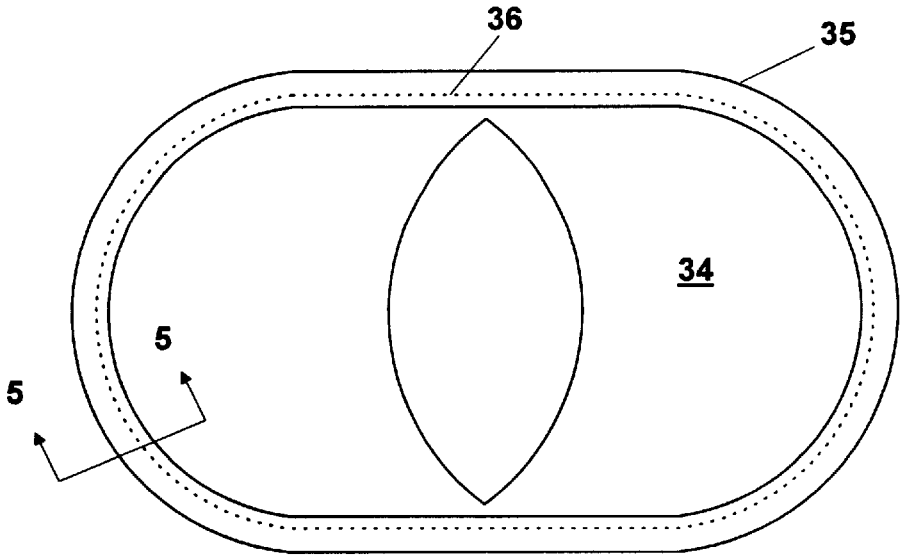
FIG. 4 shows a top view of the binding ribbon being sewn to the die cut piece.
Figure 5:
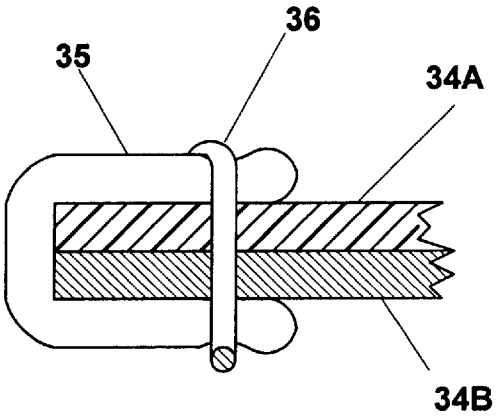
FIG. 5 is a sectional drawing of thread binding together the binding ribbon and the PVC side and cotton side of the die cut piece.

Sewing the PVC Side of the Die Cut Piece to the Cotton Side of the Die Cut Piece As shown in FIGS. 4 and 5, to strengthen the bind between PVC side 34A of die cut piece 34 and cotton side 34B of die cut piece 34; the two sides are sewn together. Preferably, binding ribbon 35 is placed along the edge of die cut piece 34, as shown in FIGS. 4 and 5. PVC side 34A, cotton side 34B and binding ribbon 35 are then sewn together using thread 36. In the preferred embodiment, binding ribbon 35 is a satin bias tape and has dimensions of 1⅞ inches by 24 inches.

Sewing the Center Opening of Die Cut Piece

Figure 6:
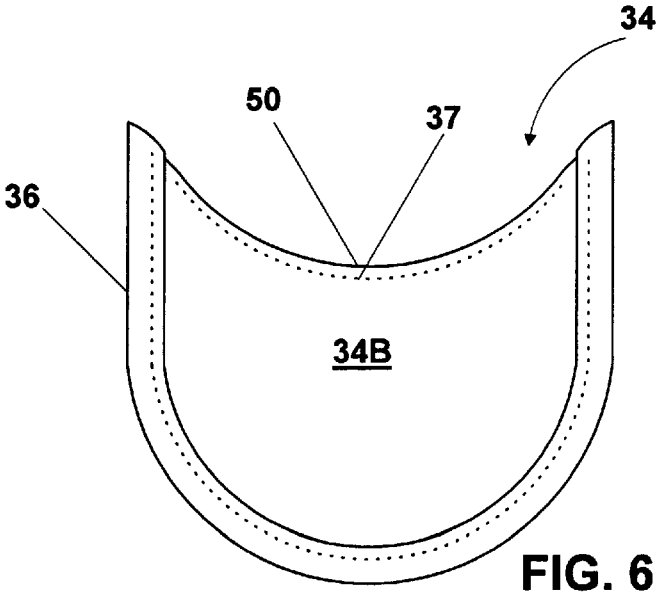
FIG. 6 shows a seam being sewn into the die cut piece.

Die cut piece 34 is folded in half so that cotton side 34B is on the outside and PVC side 34A is on the inside, as shown in FIG. 6. When folded, the boundaries of center-opening 40 (FIG. 3) form an arc 50 having a radius of about 5 inches and are sewn closed at seam 37.

B. Attaching the Straps to the Absorption Pad

Sewing the Velcro® Loop Section onto the Ribbon

Figure 7:
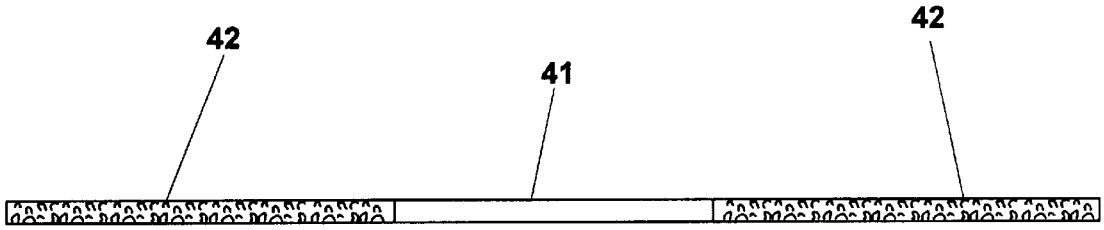
FIG. 7 shows Velcro® loop sections sewn into the ends of a ribbon in the first embodiment of the present invention.

As shown in FIG. 7, Velcro® loop sections 42 are sewn to both ends of 17 inch ribbon 41. In the preferred embodiment, Velcro® loop sections 42 are approximately ⅜ inch by 6 inch. Also, preferably, ribbon 41 is approximately ⅜ inch by 17 inches and is a ribbon finished on one side with white satin. Velcro® loop sections 42 are sewn onto the side opposite the white satin.

Sewing the Ribbon onto the Absorption Pad

Figure 8:
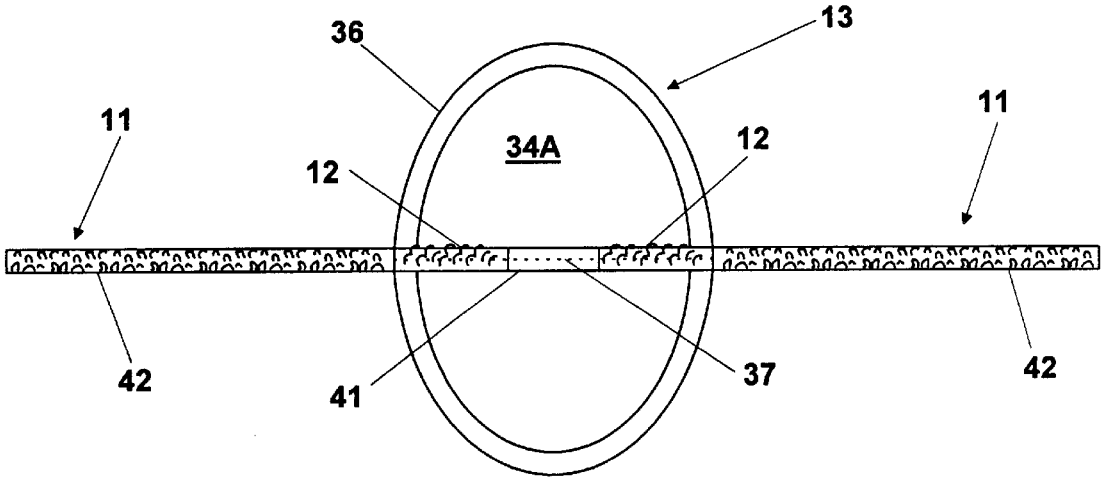
FIG. 8 shows a top view of a preferred embodiment of the present invention.

As shown in FIG. 8, ribbon 41 is sewn onto absorption pad 13 so that it covers seam 37 (FIG. 6) on PVC side 34A. Straps 11 then extend outward from absorption pad 13, as shown in FIG. 1 and FIG. 8. Velcro® hook sections 12 are then sewn over ribbon 41. In the preferred embodiment, each Velcro® hook section 12 is ⅜ inch by 2 inches.

Alternate Embodiments

Figure 9:
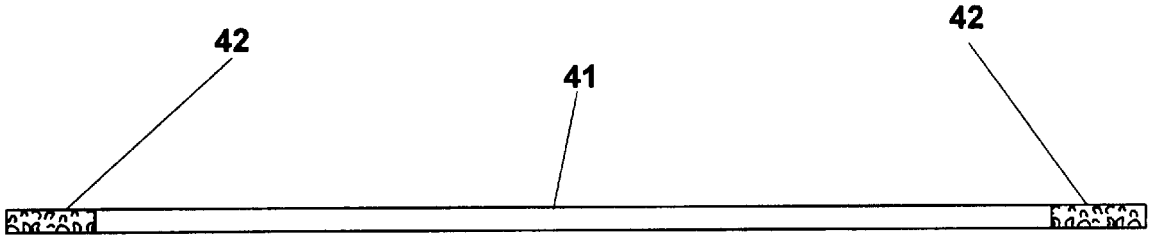
FIG. 9 shows Velcro® loop sections sewn into the ends of a ribbon in another embodiment of the present invention.
Figure 10:
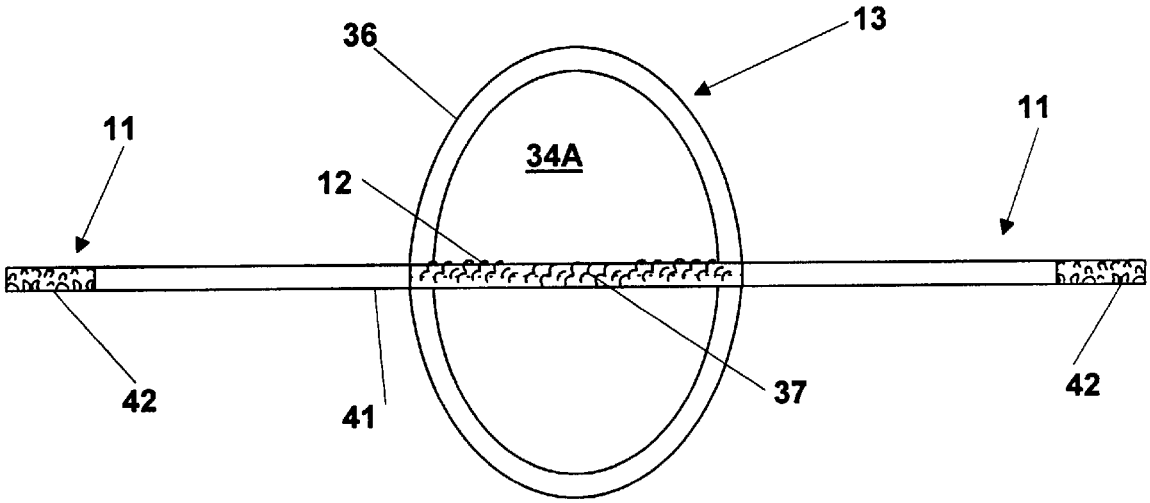
FIG. 10 shows a top view of another embodiment of the present invention.

In the first preferred embodiment, the ends of straps 11 were described as being attached to attached to absorption pad 13 with Velcro®. However, it is also possible to attach the ends of straps 11 to the absorption pad by other methods, such as with buttons or with metal snaps, or the equivalent. In the preferred embodiment, cotton side 34B was described as being located next to the armpit to absorb perspiration. However, it is possible to use other absorbent materials besides cotton. For example, polyester, silk or fleece could be used as well. Also, PVC side 34A could be replaced with other nonporous materials besides PVC, such as urethane or gortex. It is also possible to replace the PVC/Cotton laminated absorption pad 13 with an absorption pad that is composed of just one material. In other words, an absorption pad that is solid cotton would work so long as the cotton was thick enough to adequately absorb sweat so that it would not contact the wearer's clothes. Also, although the preferred embodiment was shown with binding ribbon 35 covering the edges of die cut piece 34, it is also possible to sew the PVC side to the cotton side without attaching a binding ribbon. Referring to FIGS. 9 and 10, it is also possible to vary the dimensions of hook section 12 and loop section 42. FIG. 9 shows loop sections 42 that are approximately one inch long. FIG. 10 shows a hook section 12 that extends across absorption pad 13 and is approximately 5¼ inches long. This embodiment removes some of the Velcro® along ribbon 41, which makes underarm perspiration shield 10 more comfortable for the wearer. Although it was previously stated that PVC sheet 32 was laminated to cotton sheet 31 by use of a FABRIC-TAC™, other fabric adhesives are also possible. Also, it is possible to heat laminate PVC sheet 32 and cotton sheet 31 by the use of an electric iron. Or, lamination can be achieved by a combination of fabric adhesive and heat lamination. Also, it should be noted that although in the preferred embodiment, underarm perspiration shield 10 was described as being worn connected to a bra, it is also possible to connect underarm perspiration shield 10 to other strapped garments, such as a tank top T-shirt or slip. Although this device is designed primarily for women, it may be used by men and connected to a tank top T-shirt in a manner similar to that described above.

While the above description contains many specifications, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents, and not by the examples which have been given.

What is claimed is:

1. An underarm perspiration shield for attachment to a shoulder strap of a wearer's undergarment, said shield comprising:

A) an absorption pad, defining a first edge and a second edge and a strap connection location, said absorption pad being comprised of:

(1) a perspiration absorbing material, and (2) a pivot crease running from said first edge to said second edge for permitting said pad to pivot about said crease with raising and lowering of the wearer's arm, B) a first strap permanently attached at a permanently attached end to said absorption pad at a junction of said first edge and said pivot crease, said first strap being configured to loop around a first portion of said shoulder strap an connect to said absorbing pad at said strap connection location, C) a second strap permanently attached at a permanently attached end to said absorption pad at a junction of said second edge and said pivot crease, said second strap being configured to loop around a second portion of said shoulder strap and connect to said absorption pad at said strap connection location, wherein said absorption pad is held in position at an armpit of said wearer by said first and second strap and by no other connections to said undergarment.

2. An underarm perspiration shield as in claim 1, wherein said absorption pad comprises:

A) a front layer comprised of an absorbent material, and

B) a second layer comprised of a nonporous material.

3. An underarm perspiration shield as in claim 2, wherein said absorbent material is cotton.

4. An underarm perspiration shield as in claim 2, wherein said nonporous material is PVC.

5. An underarm perspiration shield as in claim 2, wherein said nonporous material is sewed to said absorbent material defining a binding seam.

6. An underarm perspiration shield as in claim 5, further comprising a binding ribbon covering said binding seam.

7. An underarm perspiration shield as in claim 1, wherein said first and said second straps are connected to said absorption pad with a hook and loop fastener connection.

8. An underarm perspiration shield as in claim 1, wherein said first and said second straps are connected to said absorption pad with a button connection.

9. An underarm perspiration shield as in claim 1, wherein said first and said second straps are connected to said absorption pad with a snap connection.

10. A method for fabricating an underarm perspiration shield, comprising the steps of:

A) fabricating an absorption pad defining a first edge and a second edge, wherein said absorption pad is suitable for absorbing perspiration from a wearer's armpit, B) attaching one strap to each of said first and second edges each strap having an unattached end defining a connecting end of said absorption pad, wherein each of said straps are configured to loop around a shoulder strap of a wearer's undergarment, and C) attaching a connecting means to each of said straps and said absorption pad, wherein said connecting means are for connecting said connecting ends to said absorption pad, and D) providing no other mechanism for attaching the pad to the undergarment.

11. A method as in claim 10, wherein said absorption pad comprises:

A) a front layer comprised of an absorbent material, and

B) a second layer comprised of a nonporous material.

12. A method as in claim 11, wherein said fabrication of said absorption pad comprises the steps of:

A) laminating a sheet of nonporous material atop a sheet of absorbent material to form a laminated sheet defining a nonporous side and an absorbent side, B) die cutting said laminated sheet to form a die cut piece defining a die cut nonporous side, a die cut absorbent side and a die cut center-opening boundaries, C) sewing said die cut nonporous side to said die cut absorbent side, D) folding said die cut piece in half so that said die cut center-opening boundaries form an arc shape, and E) sewing said center-opening boundaries together at said arc shape, said sewing of said center-opening boundaries defining an absorption pad seam, wherein a pivot crease is formed at said absorption pad seam for facilitating the easy raising and lowering of the wearer's arm without significantly upsetting said absorption pad's position.

13. A method as in claim 11, wherein said nonporous material is PVC and said absorbent material is cotton.

14. A method as in claim 10, wherein said straps are connected to said absorption pad with a hook and loop fastener connection.

15. A method as in claim 10, wherein said straps are connected to said absorption pad with a button connection.

16. A method as in claim 10, wherein said straps are connected to said absorption pad with a snap connection.

* * * * *